US010029772B2

(12) United States Patent
Neal

(10) Patent No.: US 10,029,772 B2
(45) Date of Patent: Jul. 24, 2018

(54) FLOATATION APPARATUS

(71) Applicant: Quinton Neal, Austin, TX (US)

(72) Inventor: Quinton Neal, Austin, TX (US)

( * ) Notice: Subject to any disclaimer, the term of this patent is extended or adjusted under 35 U.S.C. 154(b) by 0 days.

(21) Appl. No.: 15/151,161

(22) Filed: May 10, 2016

(65) Prior Publication Data

US 2016/0272289 A1 Sep. 22, 2016

Related U.S. Application Data

(63) Continuation of application No. 14/334,210, filed on Jul. 17, 2014, now Pat. No. 9,352,814.

(51) Int. Cl.
*B63C 9/08* (2006.01)
*A63B 31/00* (2006.01)

(52) U.S. Cl.
CPC ..... *B63C 9/08* (2013.01); *A63B 31/00* (2013.01)

(58) Field of Classification Search
CPC ..... B63C 9/08
See application file for complete search history.

(56) References Cited

U.S. PATENT DOCUMENTS 1,932,708 A * 10/1933 Phillips, Jr. ..... B63C 9/115 441/113
5,382,184 A * 1/1995 DiForte, Jr. ..... B63C 9/155 441/108
9,352,814 B2 * 5/2016 Neal ..... B63C 9/08
2005/0106962 A1 * 5/2005 Johnson ..... B63C 9/115 441/108
2013/0323990 A1 * 12/2013 Justice ..... A63B 21/0084 441/88

* cited by examiner

*Primary Examiner* — Stephen P Avila

(57) ABSTRACT

A flotation apparatus having a first elongate member, a second elongate member, and a connector, such as an exterior housing, engaging the first and second elongate members and deforming the first elongate member into a curved shape. Ends of the first elongate member are positioned proximate to ends of the second elongate member to define gaps therebetween that permit movement of one or both elongate members relative to the other.

1 Claim, 2 Drawing Sheets

FLOATATION APPARATUS

CROSS-REFERENCE TO RELATED APPLICATIONS

The present application claims priority to the U.S. non-provisional application Ser. No. 14/334,210 filed Jul. 17, 2014 which claims priority to the provisional application for patent, having the application Ser. No. 61/958,033, filed Jul. 18, 2013, which are all incorporated by reference herein in their entirety.

FIELD

Embodiments usable within the scope of the present disclosure relate, generally, to flotation apparatuses, and more specifically, to flotation devices usable, e.g., during swimming or other recreational activities and/or as lifesaving devices, adapted to secure a user in a manner that resists separation of the user from the flotation device.

BACKGROUND

Conventionally, any object having sufficient buoyancy to float in a body of water and to support at least a portion of the weight of a human body or other object can be used as a flotation device, either for recreational, utility, or safety purposes. However, modern adaptations to this concept have led to the creation of flotation devices specifically suited to certain purposes.

For example, the "life saver" flotation device is a renowned safety apparatus, having a ring shape with a diameter sized to encircle a user's torso and/or waist, while preventing passage of the user's shoulders and/or arms, such that a user can be suspended by the device in a position that retains the user's head above water. A similar device, the inner tube, is designed primarily for recreational use, having an inflatable, ring-shaped body. In use, a user is able to lay across or stand within the open center of the tube, while the body of the tube supports the user's arms and/or legs. Numerous other types of inflatable floats (e.g., "pool floats") exist, having a variety of shapes and features, each functioning via the same concept: supporting at least a portion of a user's body atop an inflated/buoyant surface.

One common and relatively inexpensive recreational flotation device has become colloquially known as the "pool noodle" or swim noodle, due to its elongate, noodle-like shape. The pool noodle is also called a water log or woggle in various regions of the world. A pool noodle is generally an elongate, cylindrical piece of foamed material (e.g., polyethylene foam or a similar material), able to be elastically deformed by a user under the user's weight and/or using manual force. While typically unsuitable for use as a safety apparatus, pool noodles are common recreational items due to ease of construction, and inexpensive materials and manufacturing methods. In use, a user can simply grasp any portion of a pool noodle to add buoyancy to his or her body, straddle the pool noodle, or a number of other configurations and uses. However, the lack of an enclosed shape and/or structure causes engagement with a pool noodle to be difficult to maintain, as it is primarily the user's strength and/or grasp that maintains engagement with the noodle rather than the structure thereof. This difficulty is especially apparent for child-aged users, elderly users, users having disabilities, users lacking in upper body strength, etc.

Due to its deformability, one use of pool noodles includes tying and/or otherwise securing the ends thereof together to form a loop having an approximate teardrop shape. When used to form an enclosed shape in this manner, the pool noodle mimics the functionality of conventional ring-shaped flotation devices, and is often used for instructional swimming (e.g., for children and/or persons with disabilities) due to the greater security and stability provided to a user and the ability of the enclosed structure to retain a user's arms and head above water. However, the motions of children can often be unpredictable or erratic, and child-aged users, being smaller than adults, are often able to become disengaged from a pool noodle secured in this manner. These same difficulties are also present when using conventional ring-shaped floats with child-aged users. Additionally, the foamed material of pool noodles is easily damaged and/or degraded, both through regular use and the more extensive forces (impacts, chewing, extreme bending, etc.) often imparted thereto by child-aged users. Further, while a child-aged user that becomes disengaged from a floatation device may still be able to locate and grasp the device to remain above water, a blind user and/or a user that is physically and/or otherwise disabled may be unable to remain afloat should the flotation device become disengaged from the user's body.

A need exists for flotation devices usable to securely retain users in a manner that prevents disengagement of the user's body from the flotation device, while resisting degradation and/or destruction thereof.

SUMMARY

Embodiments usable within the scope of the present disclosure include flotation apparatuses that include a first elongate member (e.g., a solid or at least partially hollow cylindrical member formed from buoyant foam or a similar material), a second elongate member, and a connector engaging the first and second elongate members to one another in a manner that deforms the first elongate member into a curved shape (e.g., a horseshoe-like shape), which can position the ends thereof proximate to the ends of the second elongate member. A first gap (defined between adjacent ends of the elongate members) and a second gap (defined between adjacent opposing ends of the elongate members) allows relative movement between the elongate members. In an embodiment, deformation of the first elongate member can provide the flotation apparatus with a generally elliptical shape; however, any generally enclosed shape could be formed without departing from the scope of the present disclosure. In an embodiment, one of the elongate members (e.g., the first) can be longer than the other, e.g., to facilitate formation of an elliptical and/or other enclosed shape.

In an embodiment, the first and second elongate members can be connected by a housing that encloses the elongate members and deforms the first elongate member into a curved shape, e.g., positioning the ends of the first elongate member proximate to those of the second elongate member to define the gaps, described previously. The presence of gaps between the elongate members can permit movement thereof within the housing.

In an embodiment, the housing can include a first portion and a second portion removable therefrom. The first portion can be positioned over the first elongate member, and the second portion over the second elongate member. Two connectors (e.g., zippers or other types of engagement) can be used to engage the first portion to the second portion, and can be aligned over the first and second gaps, respectively. In use, the removability of the second portion of the housing can facilitate separation of the elongate members and/or removal thereof from the housing (e.g., for replacement, repair, storage, etc.) Alternatively or additionally, the housing can include one or more closable openings (zippers, etc.) adapted to permit removal of one or both of the elongate members from the housing.

In an embodiment, the housing can include one or more openings (e.g., holes, orifices, etc.) formed therein for permitting the exodus of fluid therefrom. For example, in use, water may permeate through the material of the housing to occupy spaces therein not occupied by the elongate members. The presence of openings formed through the housing can facilitate drainage of the water from within the housing. In one embodiment, the one or more openings can be positioned over the first elongate member, proximate to one or both ends thereof.

In various embodiments, a harness attachment can be used in conjunction with the flotation apparatus. For example, deformation of the first and/or second elongate members can provide the flotation apparatus with an enclosed shape, having an interior. A harness attachment can be positioned within the interior and engaged with the housing, the harness attachment having a width less than that of the interior (e.g., for retaining children or other users having a narrow girth to reduce the risk of disengagement from the flotation apparatus). In an embodiment, the harness attachment can include a frictional material on an interior side thereof adapted to limit movement of a body contacting the interior side. In an embodiment, the harness attachment can have a curved shape and an adjustable connector (e.g., a belt, strap, etc.) usable to modify the distance between ends of the harness attachment to accommodate the size of a body. While any manner of connector and/or engagement could be used to engage the harness attachment to the flotation apparatus, and/or the harness attachment could be integrally formed with some embodiments of the flotation apparatus, in an embodiment, two straps could extend from the exterior side of the harness apparatus (e.g., on opposite sides thereof) to encircle two respective parts of the flotation apparatus.

In an embodiment, a reinforcing member (e.g., an elongate member and/or a tubular member usable to provide durability) can be positioned between the housing and one or both of the elongate members, and/or within a hollow interior of one or both elongate members. In an embodiment, a connector (e.g., a wire, cable, rope, etc.) could be positioned within the hollow interior of the first and second elongate members to engage the members to one another.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended illustrate and plainly disclose presently preferred embodiments of the invention to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1A:
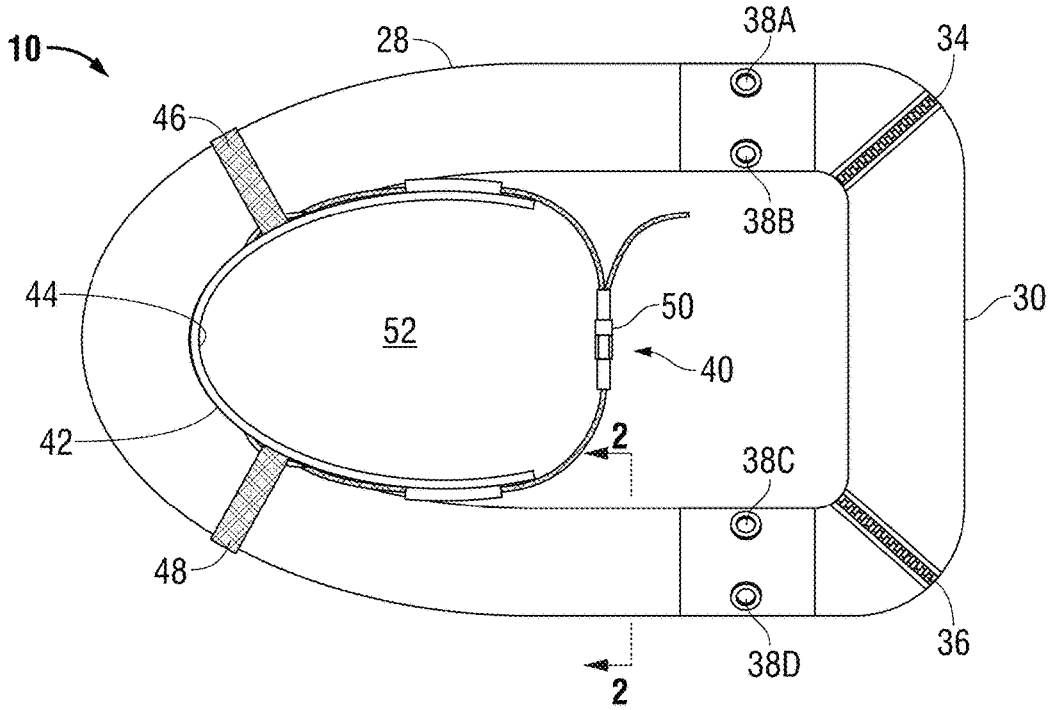
FIG. 1A depicts a top perspective view of an embodiment of a flotation apparatus usable within the scope of the present disclosure.
Figure 1B:
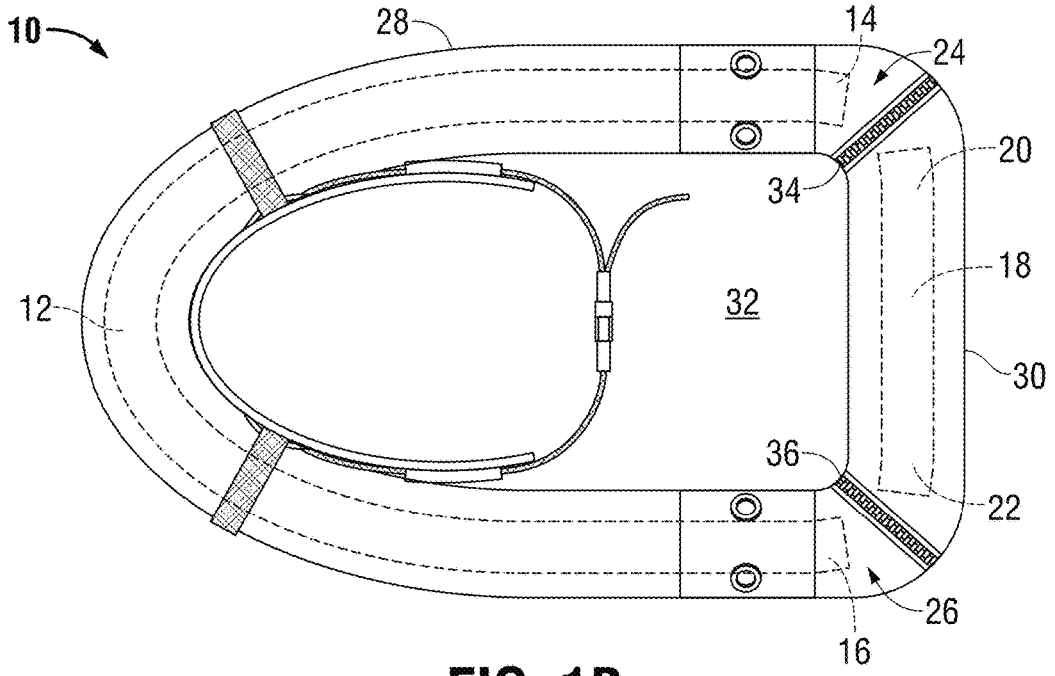
FIG. 1B depicts a diagrammatic top view of the flotation apparatus shown in FIG. 1A.

FIG. 1A depicts a top perspective view of an embodiment of a flotation apparatus (10) usable within the scope of the present disclosure. FIG. 1B depicts a diagrammatic top view of the flotation apparatus (10). As shown in FIG. 1B, the flotation apparatus (10) includes a first elongate member (12), having two opposing ends (14, 16), and a second elongate member (18), also having two opposing ends (20, 22), the two elongate members (12, 18) being positioned within a housing having two portions (28, 30). Placement within the housing (28, 30) can deform one or both of the elongate members (12, 18), providing a curved and/or horseshoe-like shape thereto, giving the flotation apparatus (10) the general shape of an ellipse or similar enclosed shape, having in interior (32).

In an embodiment, the first and second elongate members (12, 18) can be formed from a closed cell polyethylene foam, though it should be understood that any generally buoyant material can be used without departing from the scope of the present disclosure. The first elongate member (12) is shown having a length greater than that of the second elongate member (18). For example, in an embodiment, the first elongate member (12) can have a length of approximately 52 inches, and the second elongate member (18) can have a length of approximately 4 inches; however, it should be understood that the elongate members (12, 18) can have any length, depending on the desired dimensions of the overall floating device (10) and/or characteristics of intended users thereof. In an embodiment the housing can be formed from nylon, acrylic, Kevlar, urethane, plastic, rubber, other similar polymers and/or composites, or combinations thereof, with the intent that the housing be resistant to tearing and/or similar damage for providing protection to the elongate members (12, 18). It should be understood, however, that the primary function of the housing is to retain the elongate members (12, 18) in association with one another and in a desired shape and that any suitable material and/or connector could be used for this purpose without departing from the scope of the present disclosure.

For example, as shown in FIG. 1B, a first gap (24) exists between an end (14) of the first elongate member (12) and an adjacent/proximate end (20) of the second elongate member (18), and a second gap (26) exists between an opposing end (16) of the first elongate member (12) and an adjacent/proximate end (22) of the second elongate member (18). The presence of the gaps (24, 26) can permit one or both of the elongate members (12, 18) to move relative to the other, e.g., when a user's weight is applied to the flotation device (10). In use, when the flotation device (10) is supporting a user, movement of the elongate member(s) (12, 18) relative to one another can enable the flotation device (10) to at least partially conform to the body of the user to facilitate securing the user in a position that can maintain the user's head above the level of a body of water. For example, a user's body can extend through the interior (32) of the floatation device (10), while the user's arms are secured external thereto, such that the flotation device (10) supports the user's weight at or proximate to the user's arms, armpits, and/or upper chest. The downward force applied by the user's weight can cause movement of the elongate members (12, 18) such that the width of the device may narrow to contain the user's body while limiting the ability of the user's arms to pass through the interior (32). Similarly, the gaps (24, 26) can permit the elongate members (12, 18) to move in a manner that allows the flotation device (10) to accommodate a larger user.

FIGS. 1A and 1B depict a first connector (34), shown as a zipper, engaging an end of the first portion (28) of the housing to an end of the second portion (30). Similarly, a second connector (36), also shown as a zipper, is depicted engaging the opposing end of the first portion (28) to the opposing end of the second portion (30). Through disengagement of the connectors (34, 36), the second portion (30) and first portion (28) of the housing can be disengaged from one another. The first connector (34) is shown positioned over and generally in alignment with the first gap (24), while the second connector (36) is shown over and generally in alignment with the second gap (26). Placement of the connectors (34, 36) in alignment with the gaps (24, 26) (e.g., between the first and second elongate members (12, 18)) enables the connectors (34, 36) to also function as openings through which the elongate members (12, 18) can be removed from the housing, e.g., for replacement, repair, storage, etc.

In an embodiment, the housing can be formed from a material that may be at least partially permeable to water. Alternatively or additionally, it is possible that water may enter into the space between the housing and elongate members (12, 18) through the connectors (34, 36) or other locations within the flotation apparatus (10). As such, FIG. 1A depicts a plurality or orifices (38A, 38B, 38C, 38D) formed in the housing to allow the exodus of any liquid therein. In the depicted embodiment, two orifices (38A, 38B) are visible in the first portion (28) of the housing, proximate to the first end (14) of the first elongate member (12), and two orifices (38C, 38D) are visible in the first portion (28) of the housing, proximate to the second end (16) of the first elongate member. As FIG. 1A depicts a top perspective view of the flotation apparatus (10), it should be understood that additional orifices can be present in the underside thereof as well. It should further be understood that while FIG. 1A depicts four, generally circular orifices (38A, 38B, 38C, 38D), reinforced by rivets or similar structures at the perimeters thereof, positioned near the ends of the first portion (28) of the housing, any number, shape, configuration of openings can be provided, formed using any materials, without departing from the scope of the present disclosure. In various embodiments, such orifices could be omitted, and any fluid within the housing could be permitted to exit the flotation apparatus (10) via the permeability of the material of the housing and/or through the connectors (34, 36).

FIG. 1A further depicts a harness attachment (40) engaged with the flotation apparatus (10). In use, the harness attachment (40) can be used to limit movement of a user's body relative to the flotation apparatus (10) due in part to the reduced width thereof, relative to that of the interior (32) of the flotation apparatus (10), and also due to various characteristics of the harness attachment (40), itself.

The depicted harness attachment (40) includes an exterior side (42), facing the housing of the flotation apparatus (10), and an interior side (44) facing the interior (32) of the flotation apparatus (10). In an embodiment, the interior side (44) can be provided with a friction reducing material, such as rubber, one or more polymers, one or more textiles, other similar materials, or combinations thereof, such that contact between the interior side (44) and a user's body can frictionally hinder movement of the user's body relative to the flotation apparatus (10).

The harness attachment (40) is shown secured to the flotation apparatus (10) using a first strap (46) and a second strap (48), positioned on opposing sides of the harness attachment, secured to and extending from the exterior side (42) thereof, to encircle adjacent portions of the flotation apparatus (10). It should be understood that while FIG. 1A depicts two straps (46, 48) as a means of engagement between the harness attachment (40) and flotation apparatus (10), any number and/or configuration of straps could be used, and/or any other manner of engagement and/or connection could be used without departing from the scope of the present disclosure. In various embodiments, the harness attachment (40) could be integral with and/or fixedly attached to the flotation apparatus (10); however, in the depicted embodiment, the harness attachment (40) is removably attached. For example, the straps (46, 48) could be manipulated to disengage the harness attachment (40), or alternatively, the straps (46, 48) could be provided in a generally fixed configuration, and the harness attachment (40) could be removed from the flotation apparatus by disengaging one or both of the connectors (34, 36) and passing the straps (46, 48) through the resulting space between portions (28, 30) of the housing.

The harness attachment (40) is shown having a generally curved shape with two ends. An adjustable strap or belt (50) is shown securing the ends of the harness attachment (40), such that adjustment of the strap or belt (50) can modify the distance between the ends of the harness attachment (40) and/or the dimensions of the interior (52) thereof, e.g., to accommodate the size of a user's body. In an embodiment, the harness attachment (40) can be formed from a generally flexible material, including materials similar or identical to those of the housing, such that the harness attachment (40) generally conforms to the body of a user during use. Use of the harness attachment (40) can directly stabilize a user's body relative to the flotation device (10) independent of the position of a user's arms.

While the harness attachment (40) is shown as one exemplary type of attachment and/or accessory usable with the flotation apparatus (10) it should be understood that any manner of device, accessory, attachment, etc., such as lights, pockets, pouches, or other types of containers (including closable and/or water-resistant containers and/or enclosures), and the like could be secured to the exterior of the flotation apparatus (10) and/or integrally formed therewith without departing from the scope of the present disclosure.

Figure 2:
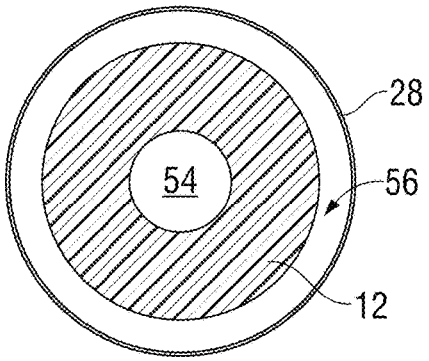
FIG. 2 depicts a side, cross-sectional view of the flotation apparatus shown in FIG. 1A, taken along line 2-2.

FIG. 2 depicts a side cross sectional view of the flotation device shown in FIGS. 1A and 1B, taken along line 2-2 of FIG. 1A, illustrating the first elongate member (12) as a generally cylindrical object, formed from a foam, resin, polymer, or similar type of buoyant material, having a hollow interior (54). While the first elongate member (12) is depicted as a hollow cylindrical body, it should be understood that elongate members having any shape and/or dimensions could be used without departing from the scope of the present disclosure, and that the elongate members could be solid, hollow, porous, and/or have any configuration of interior voids and/or spaces.

The first portion (28) of the housing is shown enclosing the first elongate member (12), defining a space (56) therebetween. It should be understood that in various embodiments the housing and/or elongate members can be sized such that the elongate members fit generally snugly within the housing, and that the depicted size of the space (56) may be enlarged for illustrative purposes. It should further be understood that a cross-sectional view of the second elongate member (18, shown in FIG. 1B) and second portion (30, shown in FIG. 1B) of the housing could be substantially identical to that shown in FIG. 2, and as such, a cross-sectional view illustrating the second elongate member and second portion of the housing has been omitted from this disclosure to avoid redundancy.

Figure 3:
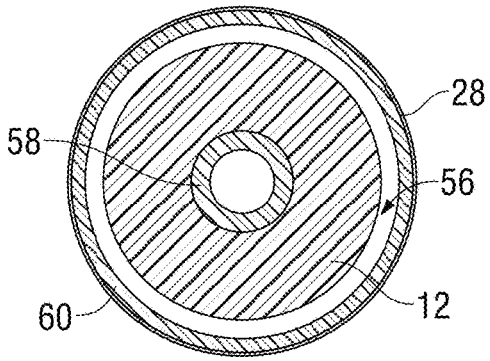
FIG. 3 depicts a side, cross-sectional view of an embodiment of a flotation apparatus usable within the scope of the present disclosure.

FIG. 3 depicts a side cross sectional view of an embodiment of a flotation device usable within the scope of the present disclosure, illustrating optional use of reinforcing members. The first elongate member (12), within the first portion (28) lo the housing is shown, having a space (56) defined therebetween, as described previously. Additionally, FIG. 3 depicts an interior reinforcing member (58), such as an elongate piece of polyvinylchloride tubing, metal, plastic, rubber, or other generally durable, flexible materials, which can be used to provide strength and/or durability to the first elongate member (12), and/or to enable non-elastic bending/deformation thereof. An exterior reinforcing member (60) is shown positioned within the space (56) about the elongate member (12), and can be used to perform identical or similar functions. While the exterior reinforcing member (60) is shown proximate to the first portion (28) of the housing, it should be understood that a reinforcing member could abut the elongate member (12) and/or fill substantially all of the space (56). While FIG. 3 depicts two reinforcing members (58, 60), it should be understood that various embodiments usable within the scope of the present disclosure could include one reinforcing member, more than two reinforcing members, or use of reinforcing members could be omitted entirely without departing from the scope of the present disclosure.

Figure 4:
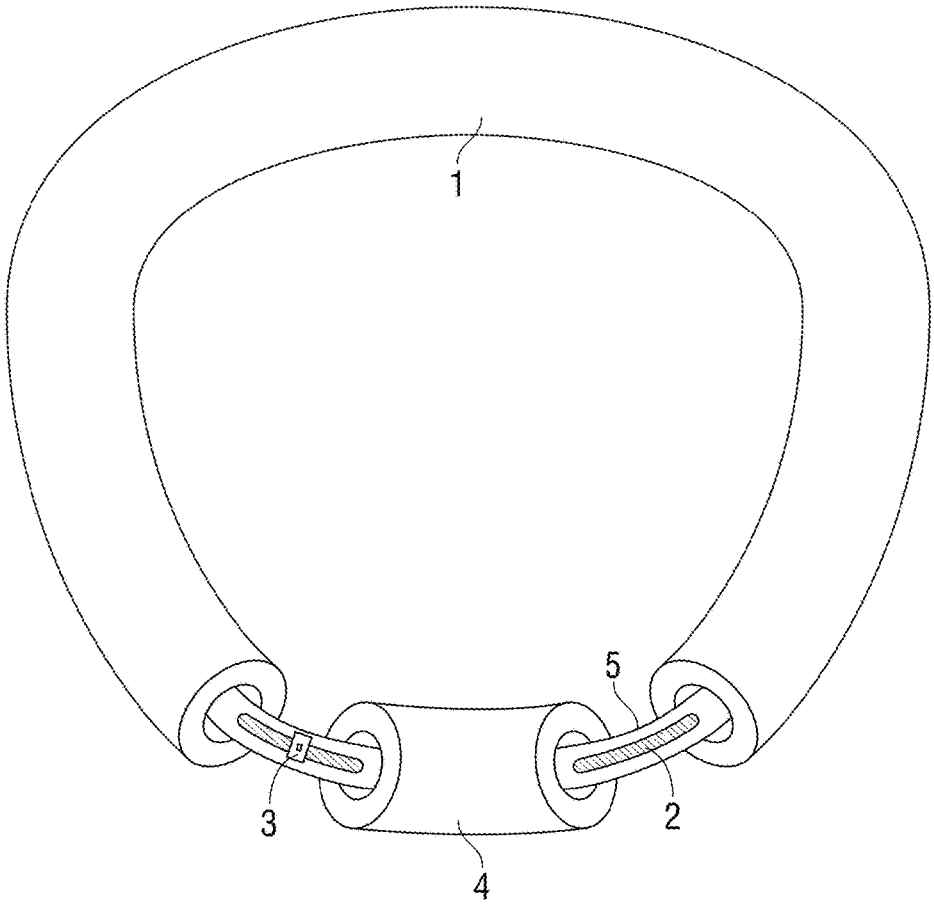
FIG. 4 depicts a perspective view of an embodiment of a flotation apparatus usable within the scope of the present disclosure.

FIG. 4 depicts an embodiment of a floatation apparatus usable within the scope of the present disclosure in which an internal connecting member is used; in an embodiment, the connector can serve the dual purpose of also reinforcing the depicted elongate members.

Specifically, FIG. 4 depicts a flotation apparatus having a first elongate member (1) (e.g., a cylindrical length of closed cell polyethylene foam, such as a "pool noodle" 52 inches in length, having an axial bore through the approximate center thereof), secured to a second elongate member (4) (e.g., a cylindrical length of closed cell polyethylene foam, such as a four-inch segment of a "pool noodle," also having an axial bore through the approximate center thereof.) A length of cord, rope, and/or cable can be used as a connector (2) (e.g., a five-foot length of stainless steel cable) to engage the first and second elongate members (1, 4) to one another, and in the depicted embodiment, the connector (2) is shown provided in association with a reinforcing member (5) (e.g., a segment of PVC tubing having a length of four feet and a width of about 0.25 inches, or similar material, having an axial bore through which the connector (2) can be inserted). FIG. 4 depicts the connector (2) as a length of steel cable, and further illustrate a ferrule (3) used to connect abutting ends of the cable; however, it should be understood that other materials and/or configurations could be used without departing from the scope of the present disclosure.

To form such a floatation apparatus, the connector (2) can be inserted into the reinforcing member (5) (e.g., axially), then the connector and reinforcing member can be inserted into the bore of the first elongate member (1) (e.g., while or after bending the first elongate member into a curved and/or horseshoe-like shape). The ferrule (3) or a similar member can be used to secure the connector (2), if a connector having unsecured ends is used. The second elongate member (4) can then have an axial cut formed therein to enable placement thereof over the remaining exposed portion of the connector (2), and the second elongate member (4) can then be reattached (e.g., using glue or other types of adhesives and/or fasteners). Alternatively, the connector (2) could be inserted through the axial bore in the second elongate member (4) prior to securing the ferrule (3).

While FIG. 4 depicts an embodiment of a flotation apparatus lacking an exterior housing, it should be understood that a housing, such as that shown in FIGS. 1A, 1B, 2, and 3, can be used in combination with the embodied apparatus shown in FIG. 4. Further, it should be understood that, as shown in FIGS. 1A, 1B, 2, and 3, use of any manner of internal connector or other member extending through the interior of the elongate members can be omitted without departing from the scope of the present disclosure. In such embodiments, the external housing or other type of external member and/or connector can be sufficient to retain the elongate members in engagement with one another.

In use, embodied flotation apparatuses can assist a user when floating on the stomach, back, or other body surface, and/or when swimming. For example, a user can simply place an embodied flotation apparatus over his or her head or legs, then position the floatation apparatus beneath the underarms (e.g., aligned with the user's stomach area). By leaning backward, the user's head, back, neck, and/or shoulders can then contact a curved portion of the flotation apparatus (e.g., the first elongate member), while the remainder of the user's body rises in the body of water, such that the flotation apparatus maintains the user's head above water. To swim, a user could similarly position an embodied flotation apparatus beneath the underarms, approximately at the midpoint of his or her body, then lean forward. An edge of the flotation apparatus (e.g., the second elongate member) can contact the user's chest, torso, and/or waist, and in an embodiment, the opposite side of the flotation apparatus can contact a user's back, leaving the user's arms and legs free to swim. To float and/or kick, e.g., in a forward direction, a user can position an embodied flotation apparatus beneath the underarms, face an edge of the float (e.g., the second elongate member), and place the arms about the sides of the apparatus. In an embodiment, the floatation apparatus can be sized such that no portion thereof is underneath the user's chest when in this position. The buoyancy of the flotation apparatus would then allow the user to remain above the level of a body of water, while kicking with his or her legs would enable forward movement.

While various embodiments usable within the scope of the present disclosure have been described with emphasis, it should be understood that within the scope of the appended claims, the present invention can be practiced other than as specifically described herein.

What is claimed is:

1. A floatation belt comprising:

a first elongate member having a first end and a second end;

a second elongate member having a third end and a fourth end;

a non-inflatable housing of closed cell foam fully enclosing the first elongate member and the second elongate member and deforming the first elongate member into a curved shape, such that the first end is proximate to the third end and second end is proximate to the fourth end, wherein a first gap is defined between the first end and third end and a second gap is defined between the second end and the fourth end, and wherein the first gap and the second gap permit movement within the housing of at least one of the first elongate member and the second elongate member relative to the other of the first elongate member and the second elongate member;

the housing further comprises a first connector at the first gap and a second connector at the second gap, both connectors being zippers; and, a harness attachment positioned interior of the housing to provide user stability and safety in the water.

* * * * *